US010611386B2

(12) United States Patent
Lu et al.

(10) Patent No.: US 10,611,386 B2
(45) Date of Patent: Apr. 7, 2020

(54) THREADED INTERFACE BUFFER WITH ANTI-ROTATION STRUCTURE

(71) Applicant: CRRC QINGDAO SIFANG ROLLING STOCK RESEARCH INSTITUTE CO., LTD., Qingdao (CN)

(72) Inventors: Qingsong Lu, Qingdao (CN); Hui Liu, Qingdao (CN); Minggang Li, Qingdao (CN)

(73) Assignee: CRRC QINGDAO SIFANG ROLLING STOCK RESEARCH INSTITUTE CO., LTD., Shandong (CN)

( * ) Notice: Subject to any disclaimer, the term of this patent is extended or adjusted under 35 U.S.C. 154(b) by 0 days.

(21) Appl. No.: 16/383,450

(22) Filed: Apr. 12, 2019

(65) Prior Publication Data

US 2019/0232981 A1 Aug. 1, 2019

Related U.S. Application Data

(63) Continuation of application No. PCT/CN2016/109230, filed on Dec. 9, 2016.

(30) Foreign Application Priority Data

Nov. 14, 2016 (CN) ..... 2016 1 1002036

(51) Int. Cl.
*B61G 9/04* (2006.01)

(52) U.S. Cl.
CPC ..... *B61G 9/04* (2013.01)

(58) Field of Classification Search
CPC ..... B61G 9/00–9/20; B61G 11/00–18
See application file for complete search history.

(56) References Cited

U.S. PATENT DOCUMENTS 3,589,527 A * 6/1971 Seay ..... B61G 9/08 213/8
3,651,953 A * 3/1972 Knippel ..... B61G 9/08 213/43

(Continued)

FOREIGN PATENT DOCUMENTS

CN 201136517 Y 10/2008
CN 201376575 Y 1/2010

(Continued)

OTHER PUBLICATIONS

The International Search Report of of corresponding International application No. PCT/CN2016/109230, dated Aug. 7, 2017.

(Continued)

*Primary Examiner* — Jason C Smith
(74) *Attorney, Agent, or Firm* — J.C. Patents

(57) ABSTRACT

A threaded interface buffer with anti-rotation structure is provided, comprising a buffer housing (1), a buffer capsule (2) and a drawbar (3), wherein the drawbar (3) comprises a connection portion (4) connected to the buffer capsule (2); the drawbar (3) is in threaded connection to the buffer capsule (2) through the connection portion (4); and, a first level anti-rotation structure (5) for limiting the rotation of the drawbar (3) and the buffer capsule (2) is mounted thereon, and a second level anti-rotation structure (6) for limiting the rotation of the drawbar (3) and the buffer housing (1) is mounted therebetween, so that the versatility and adaptability of the buffer can be enhanced and the operational stability of the buffer is ensured.

9 Claims, 5 Drawing Sheets

(56) References Cited

U.S. PATENT DOCUMENTS

| | | | | | |
|---|---|---|---|---|---|
| 4,782,740 | A * | 11/1988 | Fagin | B23P 6/02 | 188/322.22 |
| 4,953,727 | A * | 9/1990 | Tonn | B61G 9/08 | 213/43 |
| 2019/0232981 | A1 * | 8/2019 | Lu | B61G 9/04 | |

FOREIGN PATENT DOCUMENTS

| | | | |
|---|---|---|---|
| CN | 102431570 | A | 5/2012 |
| CN | 203283245 | U | 11/2013 |
| CN | 105644580 | A | 6/2016 |
| CN | 106515783 | A | 3/2017 |

OTHER PUBLICATIONS

The Chinese First Examination Report, including the Search Report, of corresponding Chinese application No. 201611002036.9, dated Jan. 26, 2018.

* cited by examiner

THREADED INTERFACE BUFFER WITH ANTI-ROTATION STRUCTURE

CROSS-REFERENCE TO RELATED APPLICATIONS

This application is a continuation of International application No. PCT/CN2016/109230 filed on Dec. 9, 2016, entitled "THREADED INTERFACE BUFFER PROVIDED WITH ANTI-ROTATION STRUCTURES", which claims priority to Chinese application No. 201611002036.9, filed on Nov. 14, 2016. The disclosures of the aforementioned applications are hereby incorporated by reference in their entirety.

TECHNICAL FIELD

The present invention relates to a buffer device for rail vehicle, and in particular to a buffer and an anti-rotation structure thereof.

BACKGROUND OF THE PRESENT INVENTION

The coupler buffer device is one of the most basic and important components of the vehicle. Its function is to connect the rail vehicle, slow down the longitudinal impact between the trains, and improve the ride comfort and the safety of the rail vehicle. The coupler buffer device is installed at the coupler joint between the vehicles. The length of the coupler buffer device varies depending on the design parameters, line conditions and operating conditions of different vehicles.

The buffer for a rail vehicle coupler buffer device is generally designed as a single integral component. In order to match the design requirements of the coupler buffer device of different lengths, the length of the buffer needs to vary with the length of the coupler buffer device. Therefore, buffers with the same parameters need to be designed with a variety of different lengths to accommodate different lengths of coupler buffer device.

Existing buffer structure typically includes a buffer capsule and a drawbar. Generally, the drawbar and the buffer capsule are designed as an integrated structure, so the length of the drawbar is fixed in the same buffer, and a new buffer is needed to replace when it is required to be used with different vehicles.

The Chinese patent with the publication No. CN201376575Y provides a magnetic levitation train head coupler buffer device, wherein the coupler buffer device is provided with a locking device, which is a locking bolt and a through hole provided on the mounting seat, and a threaded hole set on the buffer system pull ring, the locking bolt is fixed in the threaded hole through the through hole, and is fixed to the mounting seat by a nut.

SUMMARY OF THE PRESENT INVENTION

The object of the present invention is to provide a general-purpose, modular combination buffer structure to overcome the defects in the prior art that the buffer structure is integrated and the same buffer is not adapted to the different lengths of the coupler buffer device.

The technical solution of the present application is:

A threaded interface buffer with anti-rotation structure is provided, including a buffer housing, a buffer capsule and a drawbar. The buffer capsule is located inside the buffer housing. The drawbar includes a connection portion connected to the buffer capsule. The drawbar is in threaded connection to the buffer capsule through the connection portion. A first level anti-rotation structure for limiting the rotation of the drawbar and the buffer capsule is mounted on the drawbar and the buffer capsule.

Further, a second level anti-rotation structure for limiting the relative rotation of the drawbar and the buffer housing is mounted between the drawbar and the buffer housing, and the second lever anti-rotation structure covers the first level anti-rotation structure.

Figure 1:
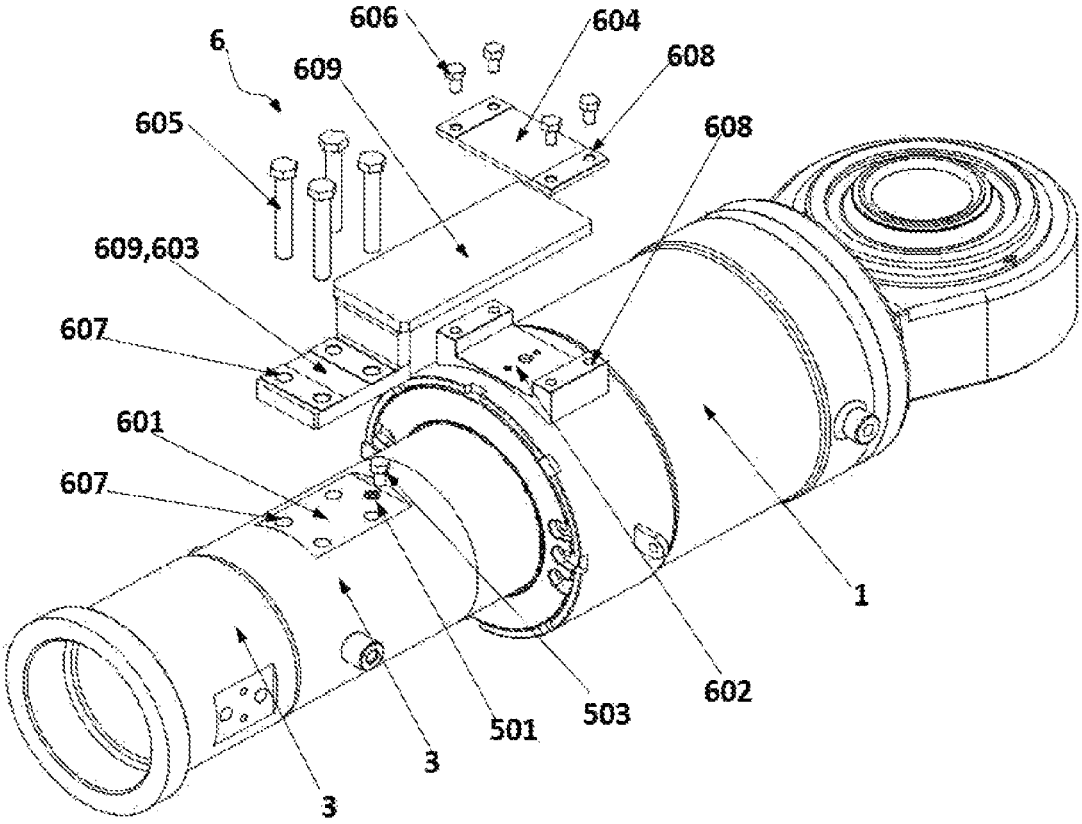
FIG. 1 is an exploded view of a combination of an anti-rotation structure and a buffer.

in which: 1 buffer housing; 2 buffer capsule (buffer cylinder); 3 drawbar; 4 connection portion; 5 first level anti-rotation structure; 501 first anti-rotation hoe; 502 second anti-rotation hole; 503 anti-rotation component; 6 second level anti-rotation structure; 601 first mounting part; 602 second mounting part; 603 first mounting surface; 604 second mounting surface; 605 first fastener; 606 second fastener; 607 first mounting hole; 608 second mounting hole; and, 609 anti-rotation plate.

DETAILED DESCRIPTION OF THE PRESENT INVENTION

The present application will be described in detail below in combination with the specific implementations. It should be understood that the following technical solutions are not only a description of simple combination of the technical solutions; if the technical solutions can implement the corresponding technical functions through a reasonable combination, it is also within the protection scope of the present application.

A threaded interface buffer with anti-rotation structure is provided, including a buffer housing, a buffer capsule and a drawbar. The buffer capsule is located inside the buffer housing. The drawbar includes a connection portion connected to the buffer capsule. The drawbar is in threaded connection to the buffer capsule through the connection portion. A first level anti-rotation structure for limiting the rotation of the drawbar and the buffer capsule is mounted on the drawbar and the buffer capsule.

As an implementation, the first level anti-rotation structure is mounted at a junction between the drawbar and the buffer capsule, including a first anti-rotation hole formed on the drawbar and a second anti-rotation hole formed on the buffer capsule, which are collectively referred to as anti-rotation hole. The positions of the anti-rotation holes on the two components are matched with each other, and aligned with each other after mounted. An anti-rotation component is inserted into the anti-rotation holes to limit the rotation of the two components.

As a preferred embodiment, the anti-rotation component is an anti-rotation screw, and correspondingly, the inner walls of the first anti-rotation hole and the second anti-rotation hole are provided with internal threads. During the assembly, the anti-rotation screw is screwed into the anti-rotation holes.

As another preferred embodiment, the anti-rotation component is an anti-rotation pin. The diameters of the anti-rotation holes are matched with the outer diameter of the anti-rotation pin, so the anti-rotation pin is directly inserted into the anti-rotation holes.

As an implementation, a second level anti-rotation structure for limiting the relative rotation of the drawbar and the buffer housing might be mounted between the drawbar and the buffer housing, including an anti-rotation plate. One end of the anti-rotation is connected to the drawbar, while the other end thereof is connected to the buffer housing.

Preferably, at a mounting position of the anti-rotation plate, i.e., at a mounting position of a first mounting surface, an outer wall of the drawbar includes a first mounting part matched with the anti-rotation plate, with the first mounting part being a flat and straight mounting part; and, at a mounting position of the anti-rotation plate, i.e., at a mounting position of a second mounting surface, an outer wall of the buffer housing includes a second mounting part matched with the anti-rotation plate, with the second mounting part being also a flat and straight mounting part. The first mounting part and the second mounting part might be planes formed by machining the outer wall of the drawbar and the outer wall of the buffer housing, respectively, or might be planes welded to the outer wall of the drawbar and the outer wall of the buffer housing, respectively.

Preferably, the anti-rotation holes are located at a junction of the anti-rotation plate with the drawbar, and the anti-rotation plate covers the anti-rotation holes. Specifically, the anti-rotation holes may be formed at the first mounting part. With such a structure, the effect of covering the first level anti-rotation structure by the second level anti-rotation structure is realized, so that the anti-rotation component is prevented from falling off and the fall-off resistance and the dual anti-rotation effect are achieved.

Or, one end of the anti-rotation plate is embedded into the first mounting part of the drawbar and closely fitted with the drawbar.

As an implementation, an internal thread is provided in the connection portion, an external thread is provided on the buffer capsule, and the two are matched with and connected to each other by the internal thread and the outer thread. As another implementation, an external thread is provided in the connection portion, an internal thread is provided at a front end of the buffer capsule, and the two are matched with and connected to each other by the internal thread and the outer thread.

As a preferred implementation, the second mounting surface is independent from the anti-rotation plate and is connected to the second mounting part; and, one end of the anti-rotation plate is mounted on the first mounting part, while the other end thereof is located between the second mounting surface and the second mounting part.

The present application has the following beneficial effects.

(1) In the present application, the integrated structure of the drawbar and the buffer capsule in the existing buffer is improved. By improving the integrated structure of the drawbar and the buffer capsule in the prior art to a threaded fit manner, a buffer structure with combined modules is provided.

(2) In the present application, the structure of the drawbar is also improved. The drawbar includes a straight rod portion and a connection portion connected to the buffer capsule. Drawbars of different buffers are different in the length of the straight rod portion. When a buffer is applied to coupler buffer devices having different lengths, the versatility and adaptability of the buffer can be enhanced by replacing the drawbar. Moreover, since the drawbar is in spiral fit to the buffer capsule, it is convenient for replacement and the structure is flexible.

(3) In order to avoid the relative rotation between the buffer capsule and the drawbar and between the buffer housing and the drawbar, the first level anti-rotation structure and the second level anti-rotation structure are designed, respectively, so that the operational stability of the buffer is ensured.

(4) Since the anti-rotation component of the first level anti-rotation structure is an anti-rotation pin or an anti-rotation screw, the anti-rotation component is possible to fall off. In the present application, the anti-rotation plate in the second level anti-rotation structure may cover the first level anti-rotation structure, the anti-rotation component in the first level anti-rotation structure is prevented from falling off, and the anti-rotation function is further realized.

The present application will be further described with reference to the accompanying drawings, in order to improving the understanding of the present application by those skilled in the art. However, it should be understood that, elements, structures, and features of an embodiment may be beneficially incorporated into other embodiments without further recitation.

The embodiments are merely described for the preferred embodiments of the present application, and are not intended to limit the scope of the present application. Various modifications and improvements may be made by those skilled in the art to the technical solutions of the present application without departing from the spirit of the present application are intended to fall within the scope of protection defined by the claims of the present application.

In the description of the present application, it should be noted that, the terms "first level", "second level", "first", "second" and the like are used for descriptive purpose only, and are not to be constructed as indicating or implying relative importance. Moreover, the use of the reference number in the present application is only for the understanding of the present application, and is not to be construed as limiting the corresponding technical solutions.

Embodiment 1

Figure 4:
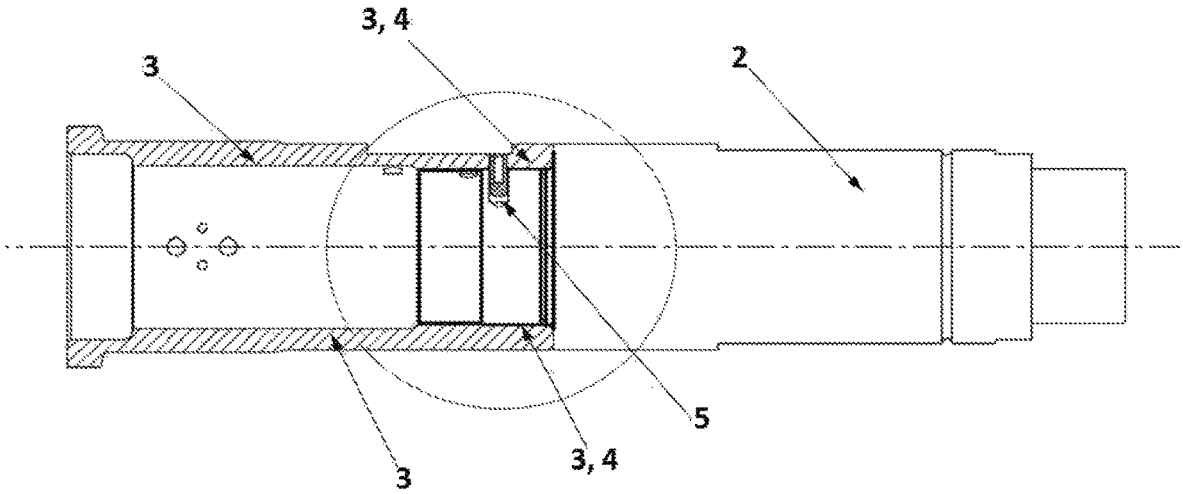
FIG. 4 is a sectional view of another implementation of the present application.
Figure 5:
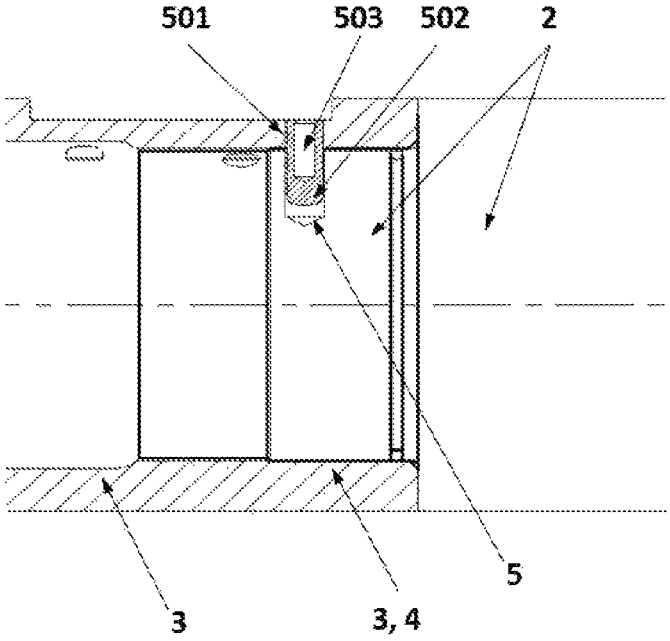
FIG. 5 is a partially enlarged view of FIG. 4.

As shown in FIGS. 1, 4 and 5, a threaded interface buffer with anti-rotation structure is provided, comprising a buffer housing 1, a buffer capsule 2 and a drawbar 3. The drawbar 3 comprises a straight rod portion and a connection portion 4 connected to the buffer capsule. The drawbar 3 is in threaded connection to the buffer capsule 2 through the connection portion 4. For example, an external thread is provided on an outer wall of the buffer capsule 2, the connection portion 4 is sheathed outside the buffer capsule 2, and an internal thread matched with the external thread on the outer wall of the buffer capsule 2 are provided on the connection portion 4. In this case, the drawbar 3 is in threaded connection to the buffer capsule 2. Alternatively, a connection structure containing an internal thread is designed at a junction of the buffer capsule 2 with the drawbar 3, and correspondingly, an external thread matched with the internal thread of the buffer capsule 2 is designed at the connection portion 4 of the drawbar 3, so that the threaded connection of the both can be realized. In FIG. 5, the first solution is employed, that is, an internal thread is provided in the connection portion 4 and an external thread is provided at one end of the buffer capsule 2, so that the threaded connection of the connection portion 4 and the buffer capsule 2 is realized. This embodiment is mainly described referred to the first connection mode. The second connection mode is similar in structure and will not be repeated here.

In order to avoid the relative rotation of the drawbar 3 and the buffer capsule 2 during the operation process, a first level anti-rotation structure 5 for limiting the rotation of the drawbar 3 and the buffer capsule 2 is mounted thereon of the two.

More specifically, the first level anti-rotation structure 5 is mounted at a junction of the drawbar 3 and the buffer capsule 2, comprising a first anti-rotation hole 501 that is an anti-rotation hole on the drawbar and a second anti-rotation hole 502 that is an anti-rotation hole on the buffer capsule. Specifically, since the connection portion 4 is sheathed outside the buffer capsule 2, the connection portion 4 is of a sleeve-shaped structure, and the first anti-rotation hole 501 runs through the wall of the sleeve-shaped connection portion 4. A second anti-rotation hole 502 matched with the position of the first anti-rotation hole 501 is also provided on the buffer capsule 2, and the buffer capsule is fitted with the connection portion 4 on an inner side of the connection portion 4. After mounted, the position of the first anti-rotation hole 501 and that of the second anti-rotation hole 502 are matched with and aligned to each other. The first anti-rotation hole and the second anti-rotation hole are generally formed by drilling after assembly. An anti-rotation component 503 is inserted into the first anti-rotation hole 501 and the second anti-rotation hole 502. Accordingly, the fitting connection of the drawbar 3 and the buffer capsule 2 is reinforced, and the relative rotation between the both is avoided.

The anti-rotation component 503 may be an anti-rotation screw. Correspondingly, internal threads matched with the external thread of the anti-rotation screw are provided on inner walls of both the first anti-rotation hole 501 and the second anti-rotation hole 502. By screwing into the screw, the drawbar 3 and the buffer capsule 2 are fixed.

As an alternative of the anti-rotation screw, the anti-rotation component 503 may also be an anti-rotation pin. Both the diameter of the first anti-rotation hole and the diameter of the second anti-rotation hole are matched with the outer diameter of the anti-rotation pin, so the fixation of the drawbar 3 and the buffer capsule 2 is realized as long as the anti-rotation pin is directly inserted into the first anti-rotation hole 501 and the second anti-rotation hole 502.

Compared with the anti-rotation screw, the anti-rotation pin do not have any spiral fitting structure, so there is a fall-off risk. Therefore, the self-stability of the anti-rotation pin is low in comparison to the use of the anti-rotation screw. By using the horizontal plane where the center axis of the drawbar is located as a reference, the first anti-rotation hole 501 and the second anti-rotation hole 502 are arranged on a plane parallel to the horizontal plane, so that the hidden risk of falling off the anti-rotation pin may be overcome to a certain extent.

Embodiment 2

Figure 2:
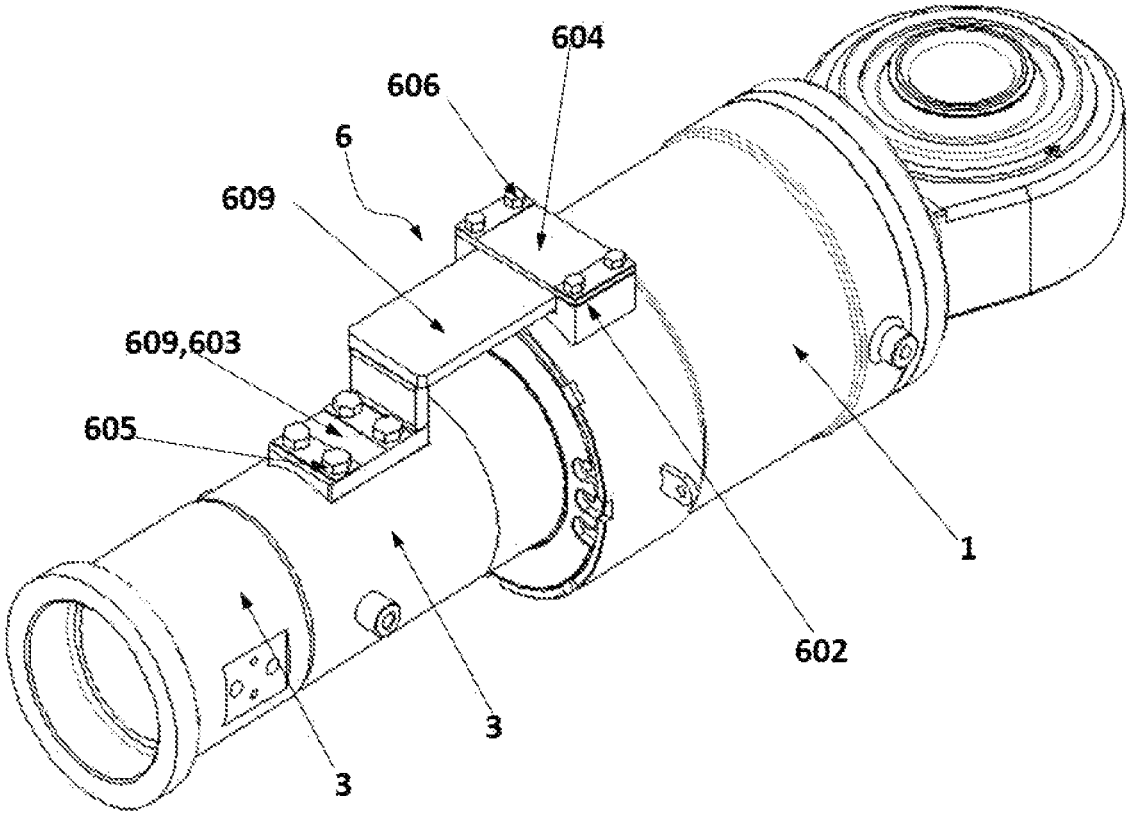
FIG. 2 is an assembly diagram of a combination of an anti-rotation structure and a buffer.
Figure 3:
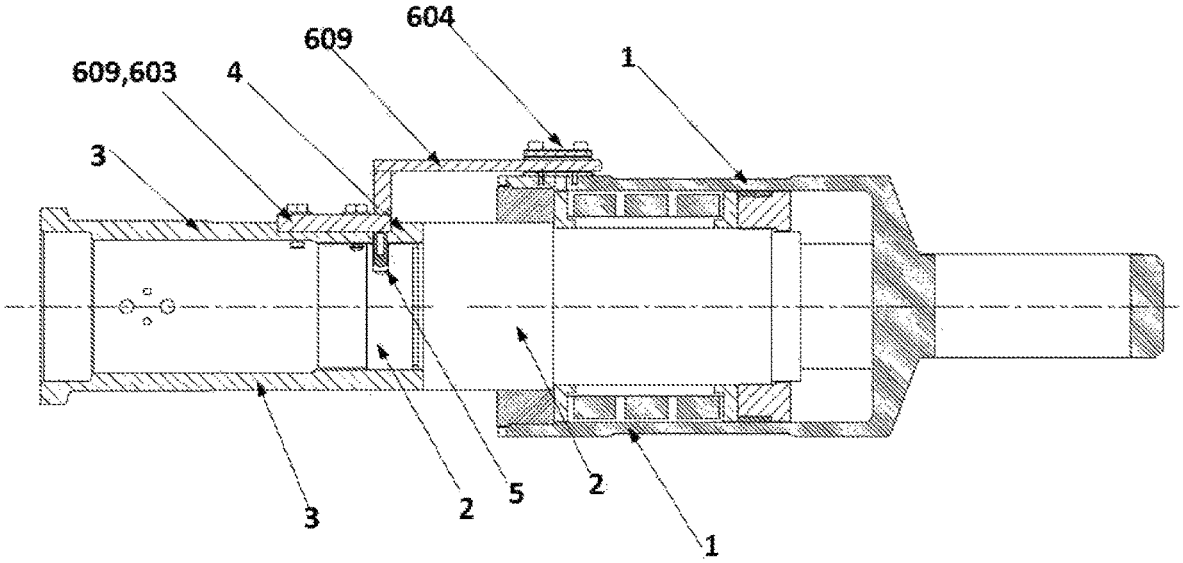
FIG. 3 is a sectional view of FIG. 1 in a longitudinal direction.

Based on Embodiment 1, as shown in FIGS. 1, 2 and 3, in order to further solve the problem of the relative rotation between the drawbar 3 and the buffer housing 1, a second level anti-rotation structure 6 for preventing the relative rotation of the drawbar 3 and the buffer housing 1 is further mounted therebetween, comprising an anti-rotation plate 609. One end of the anti-rotation plate 609 is connected to the drawbar 3, while the other end thereof is connected to the buffer housing 1. After assembled, the outer wall of the drawbar 3 and the outer wall of the buffer housing 1 are not located in the same horizontal plane, and there is a difference between upper and lower positions. A connection transition structure is further provided between mounting positions of two ends of the anti-rotation plate 609 with the drawbar 3 and with the buffer housing 1. The shape of the connection transition structure will not be limited herein. As a transition between the two ends of the anti-rotation plate 609, that the connection transition structure can connect two ends of the anti-rotation plate 609 is enough. In this embodiment, the connection transition structure is a vertical platy structure. The connection transition structure is not limited to the above structure. The specific structure of the connection transition structure may be related to the mounting environment as well as the length of the anti-rotation plate 609 connected to the drawbar 3 and the buffer housing 1.

The specific mounting structure of the anti-rotation plate 609 with the buffer housing 1 and with the drawbar 3 is as follows: a flat and straight mounting part (i.e., a first mounting part 601) matched with the anti-rotation plate 609 is designed on an outer wall of the drawbar 3, at a position corresponding to the mounting position of the anti-rotation plate, i.e., the first mounting surface 603; and, a straight mounting part (i.e., a second mounting part 602) matched with the anti-rotation plate 609 is also designed on the outer wall of the buffer housing 1, at a position corresponding to the mounting position of the other end of the anti-rotation plate, i.e., the second mounting part 602. Correspondingly, both the first mounting part 601 and the second mounting part 602 are flat and straight mounting parts, which may be in close fit with the first mounting surface 603 and the second mounting surface 604 and provided with fastener mounting holes, respectively, e.g., a first mounting hole 607 and a second mounting hole 608 shown in FIG. 1, for mounting and fixing by a first fastener 605 and a second fastener 606. The first mounting part 601 and the second mounting part 602 may be planes formed by machining the outer wall of the drawbar and the outer wall of the buffer housing, or may also be mounting grooves with planar bottoms formed by machining the outer wall of the drawbar and the outer wall of the buffer housing. With the above structure, the anti-rotation plate 609 may be stably mounted with the buffer housing 1 and the drawbar 3.

As shown in FIGS. 1-3, the first mounting surface 603 may be one end of the anti-rotation plate 609, and the second mounting surface 604 is a structure independent from the anti-rotation plate 609 and located above the other end of the anti-rotation plate 609. That is, after mounted, the other end of the anti-rotation plate 609 is located between the second mounting surface 604 and the second mounting part 602.

Furthermore, the anti-rotation plate 609 may assist in the fixation of the first level anti-rotation structure 5. The first level anti-rotation structure 5 is provided at a junction of the anti-rotation plate 609 with the drawbar 3, and the anti-rotation plate 609 covers the first level anti-rotation structure 5. More specifically, the first level anti-rotation structure 5 is located at the first mounting part 601 of the drawbar 3, that is, the anti-rotation nut or anti-rotation pin is resisted by the anti-rotation plate 609. When the anti-rotation pin is used as the anti-rotation component 501, the fall-off the anti-rotation pin may be effectively avoided by this structure.

What is claimed is:

1. A threaded interface buffer with anti-rotation structure, comprising a buffer housing, a buffer capsule and a drawbar; wherein, the drawbar comprises a connection portion connected to the buffer capsule;

the drawbar is in threaded connection to the buffer capsule through the connection portion;

a first level anti-rotation structure, for limiting the relative rotation of the drawbar and the buffer capsule, is mounted on the drawbar and the buffer capsule;

a second level anti-rotation structure, for limiting the relative rotation of the drawbar and the buffer housing, is mounted between the drawbar and the buffer housing, the second level anti-rotation structure comprises an anti-rotation plate; one end of the anti-rotation plate is connected to the drawbar, the other end of the anti-rotation plate is connected to the buffer housing.

2. The threaded interface buffer with anti-rotation structure according to claim 1, wherein the first level anti-rotation structure is mounted at a junction between the drawbar and the buffer capsule, and comprises a first anti-rotation hole formed on the drawbar and a second anti-rotation hole formed on the buffer capsule; a position of the first anti-rotation hole and a position of the second anti-rotation hole are matched with each other, and aligned with each other after mounted; an anti-rotation component (503) is inserted into the first anti-rotation hole and the second anti-rotation hole.

3. The threaded interface buffer with anti-rotation structure according to claim 2, wherein the anti-rotation component is a screw, and correspondingly, an inner wall of the first anti-rotation hole and an inner wall of the second anti-rotation hole are respectively provided with an internal thread to match with an external thread of the screw.

4. The threaded interface buffer with anti-rotation structure according to claim 2, wherein the anti-rotation component is an anti-rotation pin.

5. The threaded interface buffer with anti-rotation structure according to claim 1, wherein an outer wall of the drawbar comprises a flat and straight mounting part which matches with a first part of the anti-rotation plate; an outer wall of the buffer housing also comprises a flat and straight mounting part which matches with a second part of the anti-rotation plate.

6. The threaded interface buffer with anti-rotation structure according to claim 5, wherein one end of the anti-rotation plate is embedded into the flat and straight mounting part of the drawbar and closely fitted with the drawbar.

7. The threaded interface buffer with anti-rotation structure according to claim 5, wherein a structure with a second mounting surface independent from the anti-rotation plate is connected to the flat and straight mounting part of the buffer housing; and one end of the anti-rotation plate is mounted on the flat and straight mounting part of the drawbar, the other end of the anti-rotation plate is located between the second mounting surface and the flat and straight mounting part of the buffer housing.

8. The threaded interface buffer with anti-rotation structure according to claim 5, wherein the first anti-rotation hole and the second anti-rotation hole are located at a junction of the anti-rotation plate with the drawbar, and the anti-rotation plate covers the first anti-rotation hole and the second anti-rotation hole.

9. The threaded interface buffer with anti-rotation structure according to claim 1, wherein the first anti-rotation hole and the second anti-rotation hole are located at a junction of the anti-rotation plate with the drawbar, and the anti-rotation plate covers the first anti-rotation hole and the second anti-rotation hole.

* * * * *